US009874203B2

(12) United States Patent
Saadat et al.

(10) Patent No.: US 9,874,203 B2
(45) Date of Patent: Jan. 23, 2018

(54) DEVICES HAVING A VOLUME-DISPLACING FERROFLUID PISTON

(71) Applicant: Regents of the University of Minnesota, Minneapolis, MN (US)

(72) Inventors: Mohsen Saadat, Minneapolis, MN (US); Pieter James Gagnon, Lakewood, CO (US)

(73) Assignee: Regents of the University of Minnesota, Minneapolis, MN (US)

( * ) Notice: Subject to any disclaimer, the term of this patent is extended or adjusted under 35 U.S.C. 154(b) by 228 days.

(21) Appl. No.: 14/957,798

(22) Filed: Dec. 3, 2015

(65) Prior Publication Data

US 2017/0159682 A1 Jun. 8, 2017

(51) Int. Cl.
*F04B 3/00* (2006.01)
*F15B 21/06* (2006.01)

(52) U.S. Cl.
CPC ..... *F04B 3/00* (2013.01); *F15B 21/065* (2013.01)

(58) Field of Classification Search
CPC . F15B 15/1428; F15B 15/1447; F15B 15/149
USPC ..... 60/326
See application file for complete search history.

(56) References Cited

U.S. PATENT DOCUMENTS 4,486,026 A 12/1984 Furumura et al.
5,005,639 A 4/1991 Leland
5,638,684 A 6/1997 Siegel et al.
6,877,314 B2 4/2005 Pels
7,615,048 B2 11/2009 Yaron
8,429,913 B2 4/2013 Benik
2008/0072597 A1 3/2008 Call
2011/0219765 A1 9/2011 Niiyama et al.
2013/0001242 A1* 1/2013 Hofstetter ..... B01L 3/0217 222/333
2013/0093192 A1 4/2013 Warren
2016/0319806 A1* 11/2016 Ashouri ..... F04B 53/14

OTHER PUBLICATIONS

ARPA-E project for Liquid-piston isothermal home natural gas compressor, 2012.
Van de Ven et al., "Liquid Piston Gas Compression", Applied Energy, 2009, vol. 86, Issue 10.
Li et al., "Compressed Air Energy Storage for Offshore Wind Turbines", International Fluid Power Exhibition (IFPE) 2011.
Yan et al., "Experimental Study of Heat Transfer Enhancement in a Liquid Piston Compressor/Expander Using Porous Media Inserts", Applied Energy, 2015, vol. 154, Issue 15.

* cited by examiner

*Primary Examiner* — Michael Leslie
*Assistant Examiner* — Daniel Collins
(74) *Attorney, Agent, or Firm* — Brian D. Kaul; Westman, Champlin & Koehler, P.A.

(57) ABSTRACT

A device for use in compressing or expanding a working fluid, such as a gas, includes a container, a piston, working fluid, ferrofluid, and at least one magnetic component. The piston includes a piston face. The piston face and the container define an interior cavity having a volume that varies in response to movement of the piston relative to the container. The working fluid and the ferrofluid are contained in the interior cavity. The at least one magnetic component has a magnetic field that exerts magnetic forces on the ferrofluid that stabilize the ferrofluid in a subset of the interior cavity. This displaces the working fluid within the interior cavity.

20 Claims, 6 Drawing Sheets

DEVICES HAVING A VOLUME-DISPLACING FERROFLUID PISTON

FIELD

Embodiments of the invention are directed to devices for use in compressing or expanding a working fluid using a ferrofluid piston.

BACKGROUND

Mechanical compressors and expanders (e.g., engines, pumps, or the like) compress or expand a compressible fluid for a variety of functions. With compressors, the fluid is compressed to compactly store the fluid under high pressure for later use, such as compressed air for pneumatic tools. Typical mechanical compressors and expanders use cylinder and piston arrangements to compress or expand the fluid. Liquid pistons are used in some examples as compressors or expanders. The liquid piston fluid is formed along the face of a driven piston and provides an interface with the compressible fluid. As a compressor, the liquid piston moves relative to the cylinder to compress the compressible fluid. Conversely, as an expander (engine, motor, etc.) the compressible fluid moves the liquid piston relative to the cylinder to generate mechanical power that can be used, for example, to rotate a shaft.

One issue with the use of such liquid pistons that are positioned between the driven piston face and the compressible fluid, is that the interface between the liquid piston fluid and the compressible fluid can be subject to disturbances that can adversely affect the performance of the compressor or expander. For instance, when a liquid piston operates at relatively high frequencies that exceed one gravity of liquid piston deceleration, the liquid piston fluid is readily disturbed by the movement of the piston including acceleration and deceleration. This can cause the liquid piston fluid to be splashed along the cylinder walls and into the cylinder chamber, subjecting the liquid piston fluid to be withdrawn from the cylinder in place of the compressed or expanded compressible fluid, and adversely affecting the system efficiency. Additionally, this extraction of the liquid piston fluid decreases the volume of the liquid piston, resulting in an increase in the cylinder cavity volume. This change in the cylinder cavity volume adversely affects the compression ratio of a compressor, and the energy output produced by an expander.

SUMMARY

Some embodiments of the invention are directed to a device for use in compressing or expanding a working fluid, such as a gas. In some embodiments, the device includes a container, a piston, working fluid, ferrofluid, and at least one magnetic component. The piston includes a piston face. The piston face and the container define an interior cavity having a volume that varies in response to movement of the piston relative to the container. The working fluid and the ferrofluid are contained in the interior cavity. The at least one magnetic component has a magnetic field that exerts magnetic forces on the ferrofluid that stabilize the ferrofluid in a subset of the interior cavity. This displaces the working fluid within the interior cavity.

Another embodiment is directed to a device that includes a container that defines an interior cavity, a piston member that divides the interior cavity into first and second cavities, a first displacer in the first cavity that is configured to move relative to the container, a second displacer in the second cavity that is configured to move relative to the container, a working fluid in the first and second cavities, ferrofluid in the first and second cavities, at least one magnetic component positioned adjacent the first cavity, and at least one magnetic component positioned adjacent the second cavity. The piston member is configured to move between a first position, in which the piston member is near the first cavity and is displaced from the second cavity, and a second position, in which the piston member is near the second cavity and is displaced from the first cavity. Each of the first and second cavities includes a hot portion and a cold portion corresponding to hot and cold sections of the container. The magnetic components are configured to stabilize the corresponding ferrofluid in a subset of the corresponding first and second cavities.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
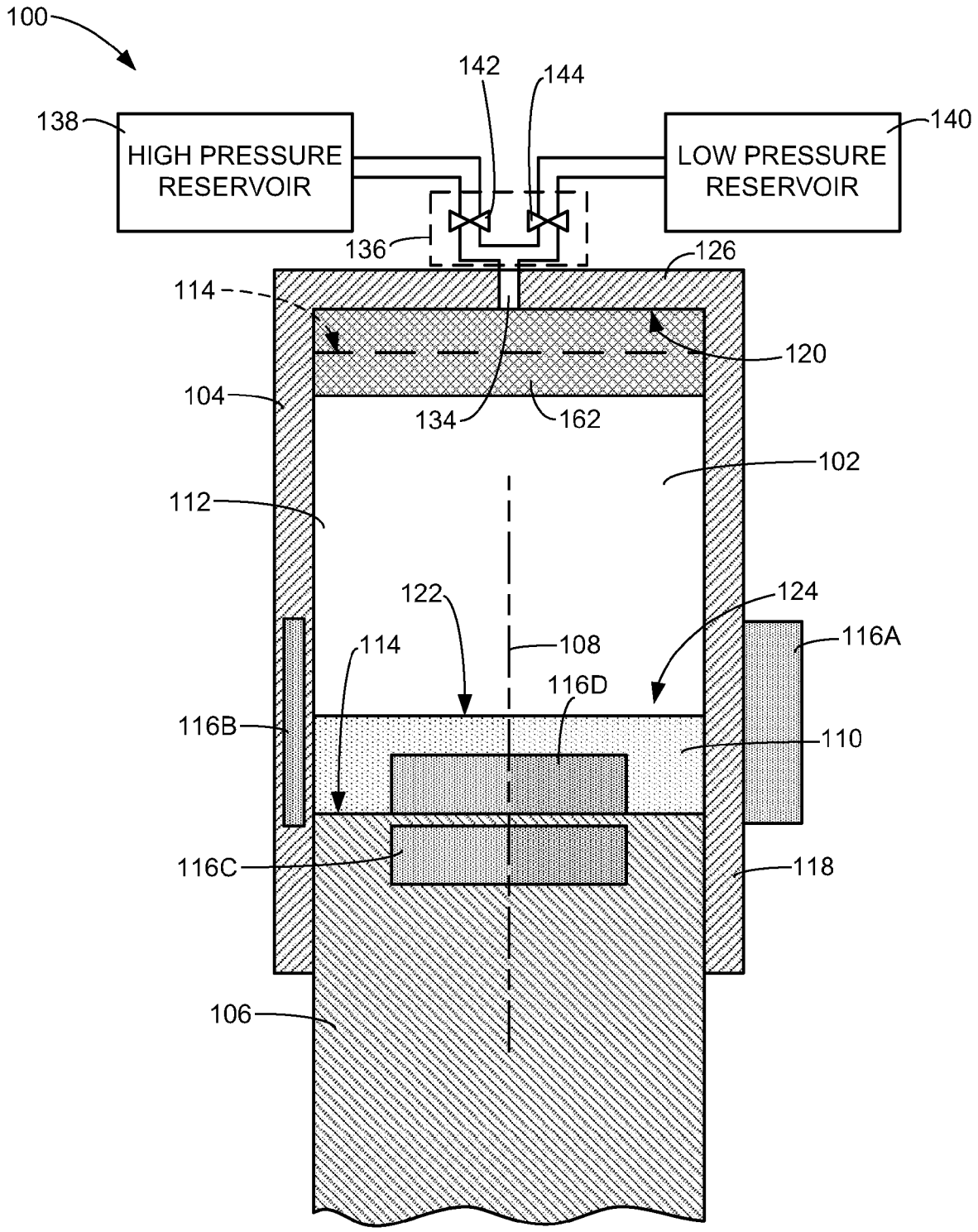
FIG. 1 is a simplified side cross-sectional view of a device for use in compressing or expanding a fluid, in accordance with embodiments of the invention.

Embodiments of the invention are directed to a device for use in compressing or expanding a working fluid, such as a compressible gas. Embodiments of the device utilize a static ferrofluid piston that results in improved performance in compressing or expanding the working fluid.

Embodiments of the invention are described more fully hereinafter with reference to the accompanying drawings. Elements that are identified using the same or similar reference characters refer to the same or similar elements. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Specific details are given in the following description to provide a thorough understanding of the embodiments. However, it is understood by those of ordinary skill in the art that the embodiments may be practiced without these specific details. For example, circuits, systems, networks, processes, frames, supports, connectors, motors, processors, and other components may not be shown, or shown in block diagram form in order to not obscure the embodiments in unnecessary detail.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the present invention may also be described using flowchart illustrations and block diagrams. Although a flowchart may describe the operations as a sequential process, many of the operations can be performed in parallel or concurrently. In addition, the order of the operations may be re-arranged. A process is terminated when its operations are completed, but could have additional steps not included in a figure or described herein.

It is understood that one or more of the blocks (of the flowcharts and block diagrams) may be implemented by computer program instructions. These program instructions may be provided to a processor circuit, such as a microprocessor, microcontroller or other processor, which executes the instructions to implement the functions specified in the block or blocks through a series of operational steps to be performed by the processor(s) and corresponding hardware components.

FIG. 1 is a simplified diagram of a device 100 for use in compressing or expanding a working or compressible fluid 102, such as a compressible gas, in according with embodiments of the invention. In some embodiments, the device 100 includes a container 104, such as a cylindrical container, and a solid piston 106. The container 104 or the piston 106 reciprocates relative to the other of the container 104 and the piston 106 along an axis 108, using conventional techniques.

In some embodiments, the device 100 includes ferrofluid 110 located within an interior cavity 112 defined by the container 104 and a piston face 114 of the piston 106. In some embodiments, the liquid ferrofluid is a conventional ferrofluid that includes a liquid base and a plurality of ferrous particles suspended in the liquid base. In some embodiments, the ferrofluid 110 is a three component magnetic fluid such as a colloid consisting of subdomain magnetic particles optionally coated with a surfactant and suspended within a carrier liquid. The surfactant is matched to the carrier liquid such that it overcomes the attractive van der Waals and magnetic forces between the particles, and prevents agglomeration.

The interior cavity 112 has a variable volume due to the ability to move the piston 106 relative to the container 104. As a result, the interior cavity 112 has an expanded state, in which the piston face 114 is displaced a relatively long distance from an opposing interior surface 120 of the container 104, as shown in FIG. 1, and a contracted state, in which the piston face 114 (shown in phantom lines) is located near the interior surface 120 of the container 104.

In some embodiments, the device 100 includes at least one magnetic component, generally referred to as 116, that comprises a permanent magnet (neodymium magnet) and/or an electro-magnet. The at least one magnetic component 116 has a magnetic field that exerts magnetic forces on the ferrofluid 110 that are directed toward the region of highest magnetic flux. In some embodiments, the magnetic field of the at least one magnetic component 116 generates magnetic forces on the ferrofluid 110 that stabilize the ferrofluid 110 in a subset of the interior cavity 112, and displaces the compressible fluid 102 to a different subset of the interior cavity 112. This allows the ferrofluid 110 to operate as a static liquid piston.

In some embodiments, the magnetic field of the at least one magnetic component 116 stabilizes or holds the ferrofluid 110 against a surface that defines the cavity 112. In some embodiments, the ferrofluid 110 is stabilized on or against a surface that defines the cavity and does not vary in response to movement of the container 104 relative to the piston 106.

In one embodiment, the magnetic field of the at least one magnetic component 116 stabilizes or holds the ferrofluid 110 against the piston face 114 of the piston 106, as shown in FIG. 1. That is, the magnetic forces applied to the ferrofluid 110 press the ferrofluid 110 against the piston face 114. In some embodiments, the ferrofluid 110 extends over and engages the entire piston face 114.

In an alternative embodiment, the magnetic field of the at least one magnetic component 116 stabilizes or holds the ferrofluid 110 against an interior surface 120 of the container 104 that opposes the piston face 114. Thus, the magnetic forces applied to the ferrofluid 110 press the ferrofluid 110 against the surface 120. While the ferrofluid 110 is illustrated in the drawings as covering the piston face 114, it is understood that the device 100 may be configured such that the ferrofluid 110 is stabilized in a subset of the interior cavity 112 such that it overlays and engages the surface 120 of the container 104 that opposes the piston face 114.

In some embodiments, the magnetic field of the at least one magnetic component 116 operates to stabilize the surface 122 of the ferrofluid at a ferrofluid-compressible fluid interface 124 during pressurization and/or depressurization of the compressible fluid 102 within the cavity 112 in response to movement of the piston 106 relative to the container 104. That is, the magnetic forces that are applied to the ferrofluid 110 balance the induced forces on the ferrofluid 110 from the no-slip boundary condition of the sidewalls of the container 104, and stabilize the surface 122 at the ferrofluid-compressible fluid interface 124. This effectively retains the ferrofluid 110 over the piston face 114 (or surface 120 of the container 104) during pressurization and depressurization of the compressible fluid 102 in response to movement of the piston 106 relative to the container 104, or at deceleration of the piston 106 of one gravity or greater relative to the container 104. Accordingly, the surface 122 is inhibited from breaking up during compression and depressurization stages of operation of the device 100.

In some exemplary embodiments, the magnetic components 116 include at least one of the exemplary magnetic components 116A-D shown in FIG. 1. Each of the magnetic components 116A-D may take on any desired shape and may represent one or more magnetic components. Furthermore, while the exemplary magnetic components 116A-D are illustrated as being used to stabilize the ferrofluid 110 on the piston face 114, the magnetic components may be repositioned to stabilize the ferrofluid 110 on the surface 120 of the container 104.

In some embodiments, the at least one magnetic component 116 includes a magnetic component that is external to the interior cavity 112, such as exemplary magnetic components 116A, 116B and/or 116C.

In some embodiments, the device 100 may include at least one magnetic component 116 that is attached to a wall of the container 104, such as exemplary magnetic component 116A that is attached to wall 118 of the container 104. The magnetic component 116A may represent one of a plurality of magnetic components that are similarly positioned around the exterior of the container 104, or a single annular magnetic component that surrounds the axis 108.

In some embodiments, the at least one magnetic component 116 includes a magnetic component 116B located within a wall of the container 104. The magnetic component 116B may represent one of a plurality of magnetic components that are similarly positioned around the exterior of the container 104, or a single annular magnetic component that surrounds the axis 108.

In some embodiments, the at least one magnetic component 116 includes a magnetic component 116C located within the piston 106. The magnetic component 116C may be centrally located within the piston 106 near the piston face 114 and be in the shape of a disc, a ring, or other desired shape. In some embodiments, the magnetic component 116C takes the form of one or more magnetic components located near a perimeter of the piston 106. When it is desired to stabilize the ferrofluid 110 on the surface 120 of the container 104, the exemplary magnetic component 116C may be located within the wall 126 of the container 104 that forms the surface 120.

In some embodiments, the at least one magnetic component 116 is located within the interior cavity 112, such as illustrated by exemplary magnetic component 116D. In some embodiments, the exemplary magnetic component 116D may be attached to the piston face 114 of the cylinder 106, an interior surface of the container 104, or attached to another location within the interior cavity 112. When it is desired to stabilize the ferrofluid 110 on the surface 120 of the container 104, the exemplary magnetic component 116D may be attached to the surface 120. As with the other exemplary magnetic components 116, the magnetic component 116D can be in the shape of a disc, a ring, or other desired shape. Magnetic component 116D also may take the form of a plurality of magnetic components.

In some embodiments, the device 100 includes at least one port 134 that is formed in a wall of the container 114, as shown in FIG. 1. It is understood that when the ferrofluid 110 is stabilized over the surface 120 of the container, the one or more ports 134 can be formed in other surfaces of the container 114, or in the piston 106.

The one or more ports 134 provide access to the interior cavity 112 and allows for the passage of the compressible fluid 102 into and out of the cavity 112. In some embodiments, the device 100 includes valving 136 that controls the flow of the compressible fluid 102 through the one or more ports 134. The valving 136 may operate in accordance with valving used in conventional compressor and expander devices.

In some embodiments, the device includes a high pressure reservoir 138 and a low pressure reservoir 140. The high pressure reservoir 138 contains the compressible fluid 102 at a high pressure, and the low pressure reservoir 140 contains the compressible fluid 102 at a low pressure relative to that of the high pressure reservoir 138. In some embodiments, the valving 136 includes a valve 142 that controls the flow of the compressible fluid 102 through the at least one port 134, and between the cavity 112 and the high pressure reservoir 138. In some embodiments, the valving 136 includes a valve 144 that controls the flow of the compressible fluid 102 through the port 134, and between the cavity 112 and the low pressure reservoir 140. In some embodiments, the valves 142 and 144 may be incorporated in a single valve assembly.

Figure 2C:
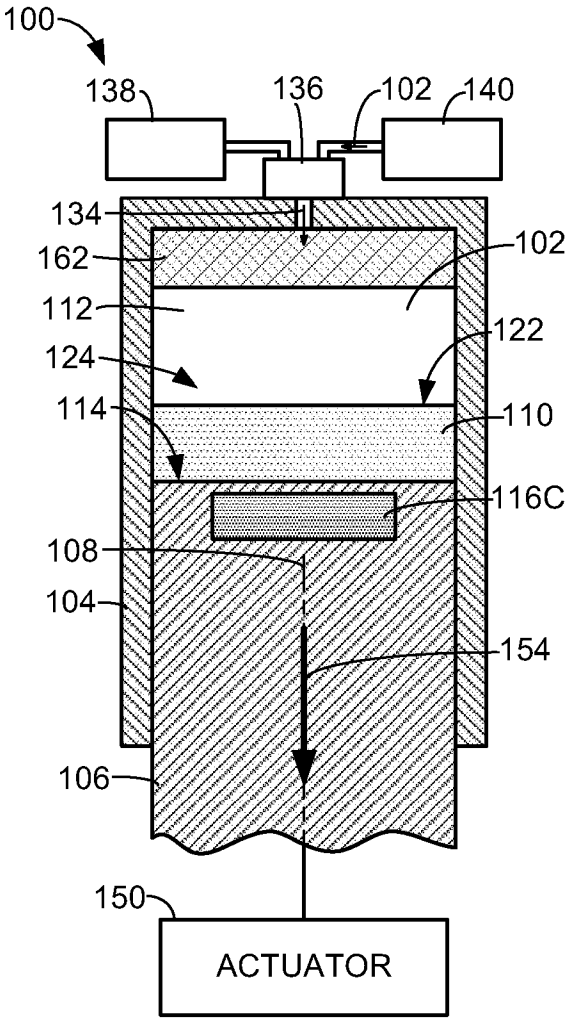
FIGS. 2A-C are simplified side cross-sectional views of the device of FIG. 1 in various stages of operation as a compressor, in accordance with embodiments of the invention.
Figure 2B:
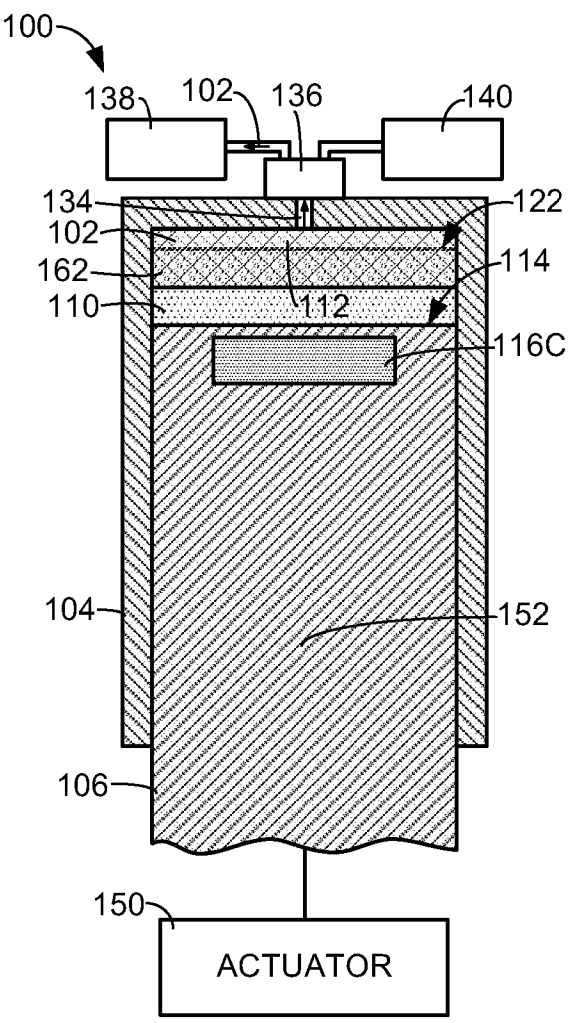
Figure 2A:
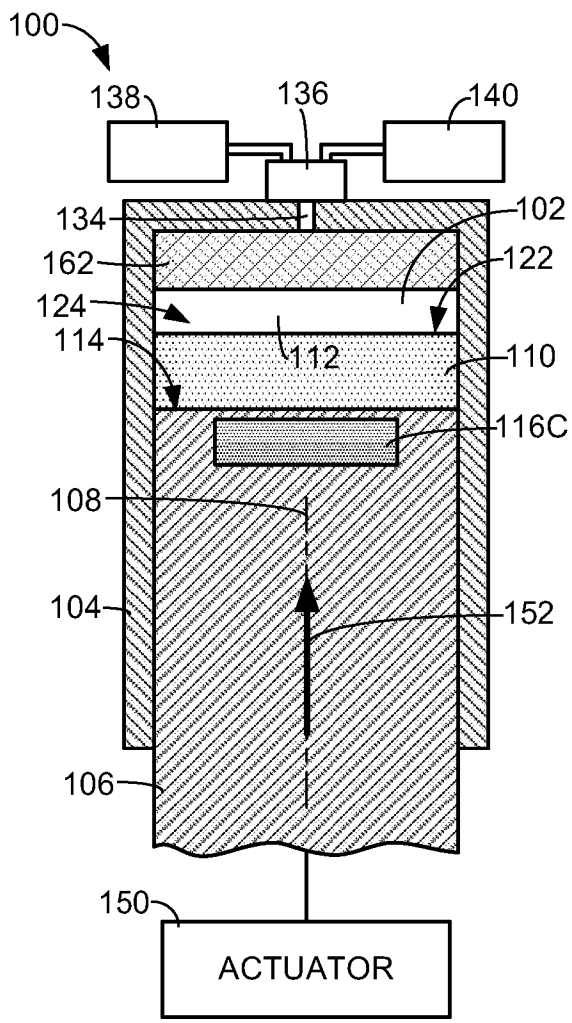

The device 100 may be operated as a compressor or an expander (i.e., an engine). Exemplary embodiments of operating the device 100 as a compressor will be described with reference to FIGS. 2A-C, which are simplified side cross-sectional views of the device of FIG. 1 in various stages of operation. While the device 100 illustrated in FIGS. 2A-C is depicted as including certain embodiments described above with regard to FIG. 1, it is understood that the device 100 may be formed in accordance with one or more of the embodiments described herein. Thus, for example, while FIGS. 2A-C illustrate the device 100 as including the magnetic component 116C, it is understood that the device 100 may include other versions of the magnetic component 116, such as those described above with regard to FIG. 1.

In some embodiments, the device 100 includes an actuator 150 that is configured to drive the reciprocating relative movement between the container 104 and the piston 106. The actuator 150 can be in the form of a conventional actuator that includes a crank-slider linkage, a cam/follower mechanism, and/or other suitable mechanism, that is driven by a motor to drive the relative movement between the container 104 and the piston 106. While the actuator 150 is illustrated as driving movement of the piston 106, it is understood that the actuator 150 could also be connected to the container 104, and drive movement of the container 104 relative to the piston 106.

In operation, the device 100 may be configured such that the cavity 112 is initially in the expanded state and low pressure state, such as shown in FIG. 1. The compression stage begins by blocking the flow of the fluid 102 through the one or more ports 134 using the valving 136 to prevent the fluid 102 from escaping the cavity 112. The actuator 150 then drives movement of the piston 106 in the direction indicated by arrow 152 relative to the container 104 to transition the cavity 112 from the expanded state toward the contracted state, as shown in FIG. 2A. During this stage of compressing the compressible fluid 102, the at least one magnetic component 116 stabilizes the ferrofluid 110 in the desired location on the piston face 114. Additionally the one or more magnetic components 116 stabilize the surface 122 at the ferrofluid-compressible fluid interface 124 during the compression of the fluid 102. This prevents the compressible fluid 102 from being entrained in the ferrofluid 110 during the compression cycle.

When the cavity 112 reaches the contracted state (FIG. 2B), such as when the pressure within the cavity 112 reaches a predetermined threshold, or when the piston 106 reaches a predetermined position relative to the container 104, the valving 136 creates a fluid pathway between the high pressure reservoir 138 and the interior cavity 112 through the at least one port 134, such as by opening valve 142 (FIG. 1). The pressurized fluid 102 is then discharged from the cavity 112 and delivered through the one or more ports 134 to the high pressure reservoir 138, as indicated by the arrows in FIG. 2B. In some embodiments, the volume of the cavity 112 may continue to be decreased during this phase of delivering the pressurized fluid 102 into the high pressure reservoir 138. Valving 136 then closes off the fluid pathway by, for example, closing the valve 142, and the cycle moves to an expansion phase.

During the expansion phase, the valving 136 creates a fluid pathway between the low pressure reservoir 140 and the interior cavity 112 through the at least one port 134, such as by opening valve 144 (FIG. 1). In some embodiments, the actuator 150 drives the piston 106 in the direction indicated by arrow 154 relative to the container 104, as shown in FIG. 2C, until the interior cavity 112 returns to the expanded state (FIG. 1). This draws fluid 102 at a low pressure from the low pressure reservoir 140 into the cavity 112, as indicated by the arrows in FIG. 2C. During this expansion of the cavity 112, the one or more magnetic components 116 maintain the ferrofluid 110 in the desired subset of the cavity 112 and, in some embodiments, over the piston face 114. Additionally, the at least one magnetic component 116 stabilizes the surface 122 of the ferrofluid 110 at the ferrofluid-compressible fluid interface 124, and prevents the compressible fluid 102 from being entrained in the ferrofluid 110 during the expansion of the cavity 112.

Figure 3C:
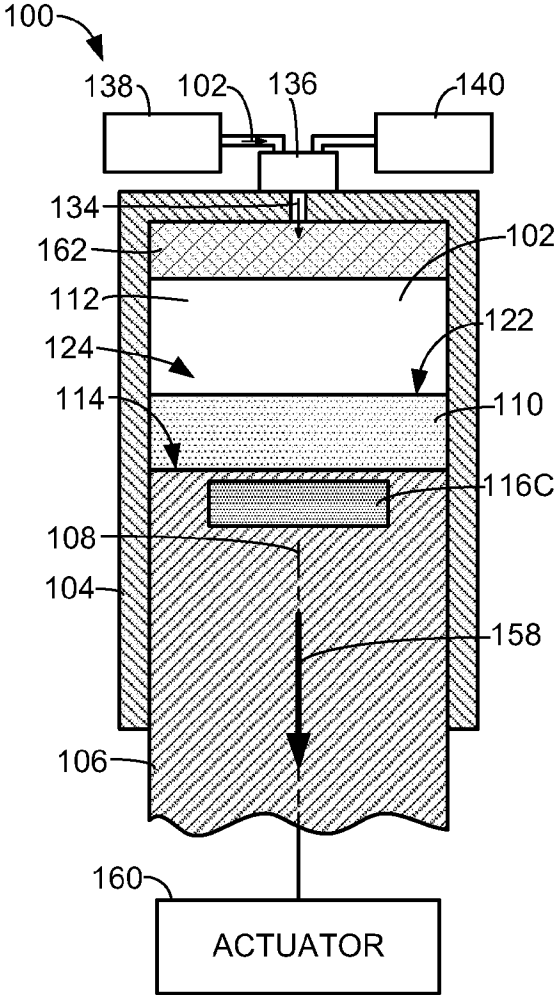
FIGS. 3A-C are simplified side cross-sectional views of the device of FIG. 1 in various stages of operation as an expander, in accordance with embodiments of the invention.
Figure 3B:
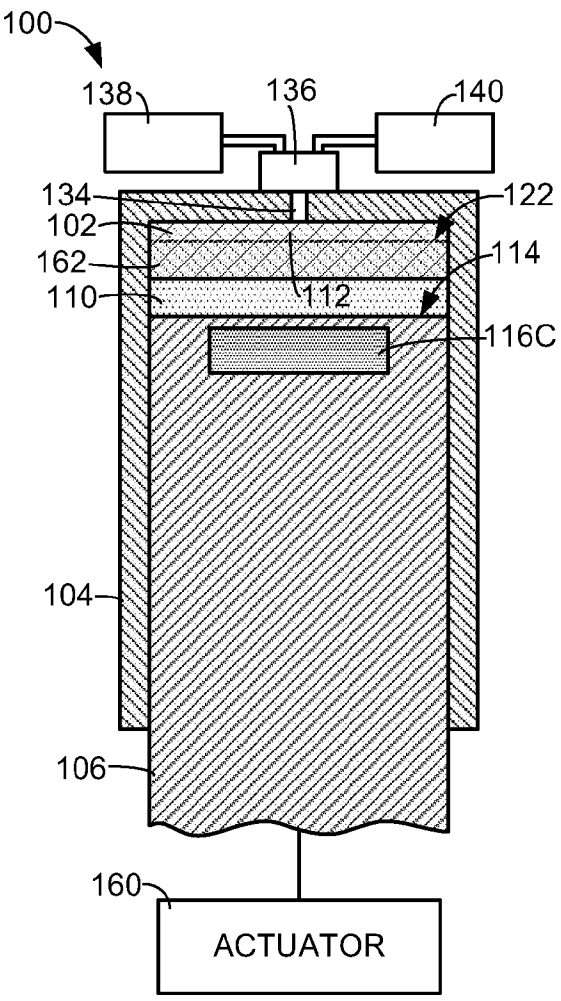
Figure 3A:
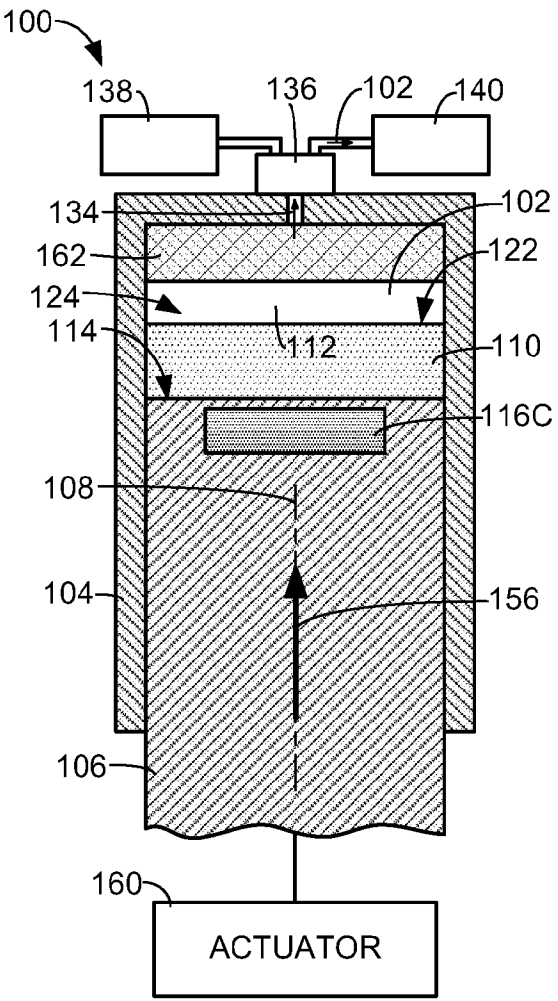

Exemplary embodiments of operating the device 100 as an expander will be described with reference to FIGS. 3A-C, which are simplified side cross-sectional views of the device of FIG. 1 in various stages of operation. While the device 100 illustrated in FIGS. 3A-C is depicted as including certain embodiments described above with regard to FIG. 1, it is understood that the device 100 may be formed in accordance with one or more of the embodiments described herein. Thus, for example, while FIGS. 3A-C illustrate the device 100 as including the magnetic component 116C, it is understood that the device 100 may include other versions of the magnetic component 116, such as those described above with regard to FIG. 1.

In some embodiments of the expander configuration of the device 100, the container 104 and the piston 106 is coupled to an actuator 160 that translates the relative motion between the container 104 and the piston 106 into useful working energy. The actuator 160 can be in the form of a conventional actuator that includes a crank-slider linkage, a cam/follower mechanism, and/or other suitable mechanism, that is driven by the relative motion between the container 104 and the piston 106.

During an expansion operation, the device 100 may initially be in the configuration illustrated in FIG. 1 with the cavity 112 in the expanded state with the contained fluid 102 at low pressure. The cavity 112 is then fluidically coupled to the low pressure reservoir 140 through the one or more ports 134 using the valving 136, while simultaneously preventing fluid flow between the cavity 112 and the high pressure reservoir 138. This may be accomplished by, for example, opening the valve 144 and closing valve 142 (FIG. 1). As the piston moves the direction of arrow 156 relative to the container 104, the fluid 102 is driven through the one or more ports 134 and into the low pressure reservoir 140, as indicated by the arrows in FIG. 3A, until the cavity reaches the contracted state, as shown in FIG. 3B.

When the cavity 112 reaches the contracted state, the valving 136 closes the fluid pathway between the cavity 112 and the low pressure reservoir 140, and opens a fluid pathway between the cavity 112 and the high pressure reservoir 138, such as by closing the valve 144 and opening the valve 142 (FIG. 1). This allows the compressible fluid 102 to travel from the high pressure reservoir 138 into the cavity 112 through the at least one port 134, as indicated by the arrows in FIG. 3C. This increases the pressure within the cavity 112, and drives relative movement between the container 104 and the piston 106, as indicated by arrow 158 in FIG. 3C, until the cavity 112 returns to its expanded state illustrated in FIG. 1. The reciprocating relative motion between the container 104 and the piston 106 drives the actuator 160 to perform useful work, in accordance with conventional expanders.

Figure 5:
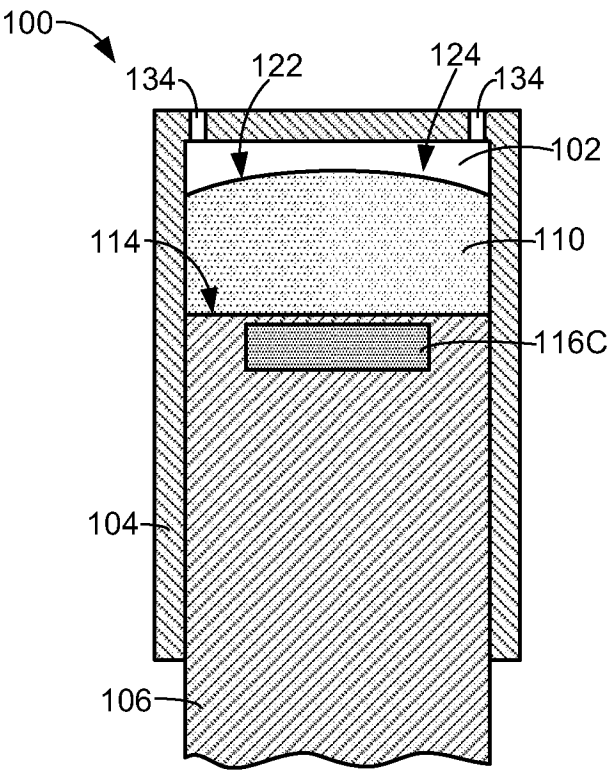
FIGS. 4 and 5 are simplified side cross-sectional views of the device of FIG. 1 illustrating exemplary shapes of a surface of a ferrofluid at a ferrofluid-compressible fluid interface, in accordance with embodiments of the invention.
Figure 4:
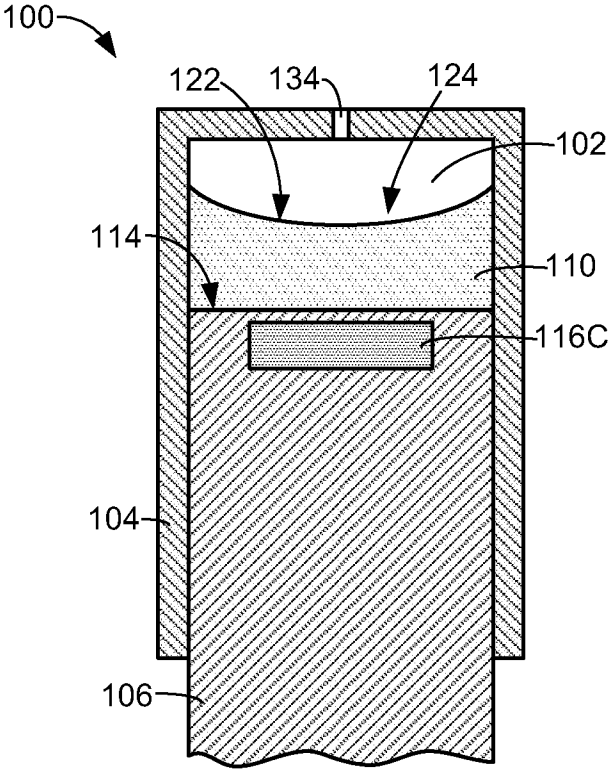

As mentioned above, the one or more magnetic components 116 stabilize the surface 122 of the ferrofluid 110, in addition to stabilizing the ferrofluid 110 in the desired subset of the cavity 112. In some embodiments, the one or more magnetic components 116 stabilize the surface 122 of the ferrofluid 110 in a desired shape. In one exemplary embodiment, the magnetic field generated by the one or more magnetic components 116 stabilizes the surface 122 of the ferrofluid 110 in a substantially planar shape, as shown in FIG. 1. In accordance with another embodiment, the magnetic field generated by the one or more magnetic components 116 stabilizes the surface 122 of the ferrofluid 110 in a substantially non-planar shape, such as shown in FIGS. 4 and 5, which are simplified side-views of portions of the device 100, in accordance with embodiments of the invention. For instance, the magnetic field generated by the one or more magnetic components 116 may be configured to stabilize the surface 122 of the ferrofluid 110 in a concave shape, as shown in FIG. 4, or a convex shape, as shown in FIG. 5.

In some embodiments, the one or more ports 134 are positioned to allow the ferrofluid 110 to contact the surface 120 without exposing the one or more ports 134 to the ferrofluid 110. For some shapes of the ferrofluid surface 122, this can allow the cavity 112 to reach a lower volume in its contracted state than would reasonably be attainable when the surface 122 is stabilized in a substantially planar shape (FIG. 1). For example, when the surface 122 takes on a concave shape (FIG. 4), the one or more ports 134 may be more centrally along the axis 108. This allows the outer edges of the surface 122 of the ferrofluid to engage the surface 120 of the container 104 without exposing the port 134 to the ferrofluid 110, as indicated in phantom lines. Likewise, when the surface 122 takes on a convex shape (FIG. 5), the one or more ports 134 may be distributed around the perimeter of the surface 120, thereby allowing a central region of the surface 122 of the ferrofluid 110 to contact the surface 120 without exposing the port 134 to the ferrofluid 110, as indicated in phantom lines in FIG. 5. Accordingly, non-planar shaped ferrofluid surfaces 122 may provide advantages over the planar shaped ferrofluid surface 122.

It is generally desirable to transfer heat to and from the fluid 102 to improve the efficiency of the compression or expansion operations. In some embodiments, the device 100 includes a heat transfer structure 162 within the cavity 112, as shown in FIG. 1. The heat transfer structure 162 operates to increase the surface area through which heat may be transferred with the fluid 102. The heat transfer structure 162 may be thermally coupled to a heat exchanger through, for example, the surfaces of the container 104 that are exposed to the cavity 112 and the piston face 114.

In some embodiments, the heat transfer structure 162 comprises a thermally conductive material, and the structure 162 is penetrable by the compressible fluid 102 and the ferrofluid 110. In some embodiments, the heat transfer structure 162 is a porous structure formed of tubes, posts, fins, plates, wire mesh, or other suitable heat transfer structure.

For the compression operation (FIGS. 1 and 2A-C), as the fluid 102 is compressed (FIG. 2A), its temperature increases and heat energy in the fluid 102 is transferred to the heat transfer structure 162. This assists in maintaining the compressible fluid 102 at a lower temperature, which results in more efficient operation. For the expander (FIGS. 1 and 3A-C), as the compressible fluid 102 expands (FIG. 3C), its temperature drops, and the heat energy within the heat transfer structure 162 is transferred into the compressible fluid 102. This keeps the compressible fluid 102 at a more constant temperature than if the device 100 lacked the heat transfer structure 162, resulting in more efficient operation of the device 100.

Heat is also transferred between the ferrofluid 110 and the heat transfer structure 162. The ferrofluid 110 is generally displaced from the heat transfer structure 162 when the interior cavity 112 is in the expanded state, as shown in FIG. 1. During a compression operation, as the cavity 112 moves to the contracted state (FIG. 2A), the heat transfer structure 162 is immersed in the ferrofluid 110, as shown in FIG. 2B, and a portion of the heat energy acquired by the heat transfer structure 162 during the compression of the fluid 102 (FIGS. 2A and 2B) is transferred into the ferrofluid 110. In some embodiments, the temperature of the ferrofluid 110 is controlled through conventional approaches, such as passive fin cooling or active cycling through a radiator. This transfer of heat to the ferrofluid 110 lowers the temperature of the heat transfer structure 162 making it capable of extracting more heat from the fluid 102 during the next compression cycle.

During an expansion operation, the heat transfer structure 162 is immersed in the ferrofluid 110 as the cavity is transitioned from the expanded state to the contracted state (FIGS. 3A and 3B), and a portion of the heat energy transferred from the heat transfer structure 162 to the compressible fluid 102 during the expansion phase (FIG. 3C) is replenished by the ferrofluid 110. In some embodiments, the temperature of the ferrofluid 110 can be controlled through conventional approaches, such as passive fin heat transfer or active cycling through another heat transfer device, for example. This transfer of heat to the heat transfer structure 162 raises the temperature of the heat transfer structure 162 making it capable of transferring more heat to the fluid 102 during the next expansion cycle.

The magnetic field generated by the at least one magnetic component 116 assists in the above-described heat transfer processes when the device 100 includes the heat transfer structure 162. For instance, the magnetic field generated by the at least one magnetic component 116 operates to maintain the ferrofluid 110 over the piston face 114, or the surface 120 of the container 104. As a result, when the heat transfer structure 162 is removed from the ferrofluid 110 as the cavity 112 expands from the contracted state to the expanded state (FIGS. 2C and 3C), the magnetic field generated by the at least one magnetic component 116 pulls the ferrofluid 110 from the heat transfer structure 162 to keep it in the desired subsection of the cavity 112 against either the piston face 114, or the surface 120 of the container 104. This prevents residual ferrofluid 110 from clinging to the heat transfer structure 162. Without the magnetic field generated by the at least one magnetic component 116, the ferrofluid 110 would cling to portions of the heat transfer structure 162 after removal of the heat transfer structure 162 from the pool of ferrofluid 110. This would reduce the exposed surface area of the heat transfer structure 162, thereby reducing its effectiveness at transferring heat to or from the compressible fluid 102.

Additional embodiments are directed to a device 170, embodiments of which will be described with reference to FIGS. 6A-D, which are simplified side views of the device 170 in various stages of operation. Some embodiments of the device 170 are configured to operate as a heat engine, as described below. Additional embodiments of the device 170 are configured to operate as a heat pump, which is essentially the reverse operation of the heat engine embodiment, as understood by those of ordinary skill in the art.

In some embodiments, the device 170 includes a container 174 having hot sections 174A and cold sections 174B, formed using conventional techniques. In some embodiments, the container 174 is cylindrical and has a central axis 175.

In some embodiments, the device 170 includes a piston member 176 that divides an interior cavity 178 of the container 174 into cavities 178A and 178B. In some embodiments, the hot sections 174A of the container 174 heat the corresponding sections of the cavities 178A and 178B to form hot portions 180A and 180B in the cavities 178A and 178B, respectively. Likewise, the cold sections 174B of the container 174 cool the corresponding sections of the cavities 178A and 178B to form cold portions 182A and 182B in the cavities 178A and 178B, respectively. The temperature differential between the hot portions 180A and 180B and the cold portions 182A and 182B is the means by which energy is input into the device 170.

Figure 6A:
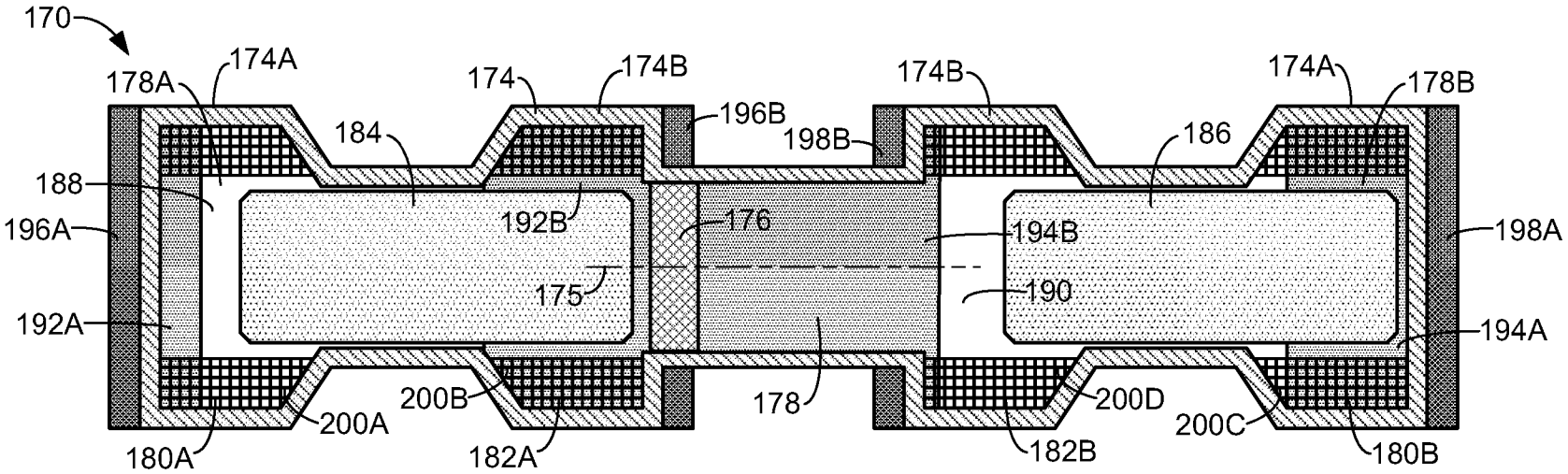
FIGS. 6A-D are simplified side cross-sectional views of a heat engine in various operational stages, in accordance with embodiments of the invention.
Figure 6B:
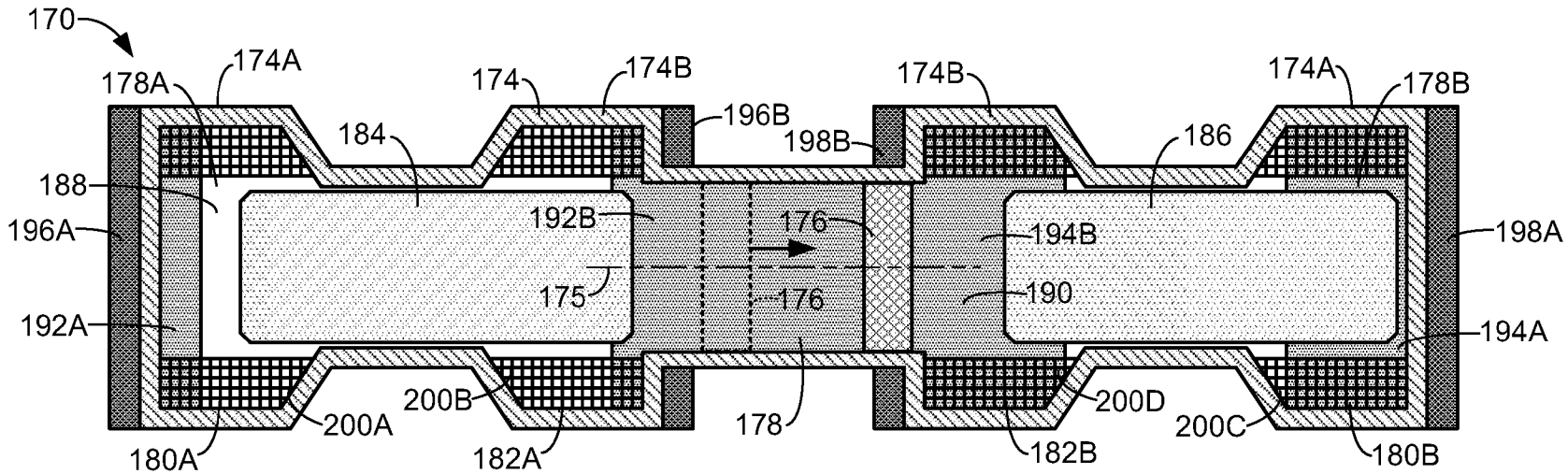

In some embodiments, the piston member 176 is configured to move between a first position, shown in FIG. 6A, in which the piston member 176 is near the first cavity 178A and is displaced from the second cavity 178B, and a second position, shown in FIG. 6B, in which the piston member 176 is near the cavity 178B and is displaced from the cavity 178A. In some embodiments, the device 170 operates as a heat engine and the piston member 176 can be used to transfer mechanical, electrical, pneumatic, or hydraulic energy out of the device 170. Alternatively, the device 170 may operate as a heat pump, as understood by those skilled in the art, by reversing the operation of the heat engine described below.

In some embodiments, the device 170 includes displacers 184 and 186 that are respectively contained in the cavities 178A and 178B. In some embodiments, the displacer 184 is configured to move relative to the container 174 in the cavity 178A, and the displacer 186 is configured to move relative to the container 174 in the cavity 178B.

The cavities 178A and 178B also contain working or compressible fluids 188 and 190, respectively. In some embodiments, the compressible fluids 188 and 190 are gases.

In some embodiments, the device 170 includes volumes of ferrofluid, generally referred to as 192 and 194, respectively in the cavities 178A and 178B. The volumes of ferrofluid 192 and 194 are respectively used as an additional displacer of the compressible fluids 188 and 190 within the cavities 178A and 178B, to further control the location of the compressible fluids 188 and 190 within the cavities 178A and 178B.

In some embodiments, the device 170 includes one or more magnetic components, generally referred to as 196, that operate to stabilize one or more volumes of the ferrofluid 192 within a subset of the cavity 178A. In some embodiments, the device 170 includes one or more magnetic components, generally referred to as 198, that operate to stabilize one or more volumes of the ferrofluid 194 within a subset of the cavity 178B. The stabilized volumes of ferrofluid 192 and 194 operate to displace volumes of the compressible fluids 188 and 190 to different subsets of the cavities 178A and 178B, respectively.

In some embodiments, the one or more magnetic components 196 include a magnetic component 196A positioned adjacent the hot portion 180A of the cavity 178A. The magnetic field generated by the magnetic component 196A applies magnetic forces to the ferrofluid 192A within the hot portion 180A that hold or stabilize the ferrofluid 192A in the hot portion 180A. In some embodiments, the one or more magnetic components 196 include a magnetic component 196B positioned adjacent the cold portion 182A of the cavity 178A. The magnetic field generated by the magnetic component 196B applies magnetic forces to the ferrofluid 192B within the cold portion 182A that hold or stabilize the ferrofluid 192B in the cold portion 182A.

In some embodiments, the one or more magnetic components 198 include a magnetic component 198A positioned adjacent the hot portion 180B of the cavity 178B. The magnetic field generated by the magnetic component 198A applies magnetic forces to the ferrofluid 194A within the hot portion 180B that hold or stabilize the ferrofluid 194A in the hot portion 180B. In some embodiments, the one or more magnetic components 198 include a magnetic component 198B positioned adjacent the cold portion 182B of the cavity 178B. The magnetic field generated by the magnetic component 198B applies magnetic forces to the ferrofluid 194B within the cold portion 182B that hold or stabilize the ferrofluid 194B in the cold portion 182B During operation of the device 170, the displacer 184 is initially positioned such that it substantially extends into the cold section 182A of the cavity 178A, and the displacer 186 is positioned such that it substantially extends into the hot portion 180B of the cavity 178B, as shown in FIG. 6A. The position of the displacer 184 displaces the ferrofluid 192B to substantially fill the cold section 182A, which displaces the compressible fluid 188 into the hot portion 180A. The magnetic component 196B stabilizes the ferrofluid 192B in the cold section 182A and prevents the ferrofluid 192B from traveling to the hot section 180A. The magnetic component 196A stabilizes the ferrofluid 192A in the cold section 180A. Thus, the compressible fluid 188 within the hot portion 180A of the cavity 178A is exposed to the hot section 174A of the container 174, resulting in a transfer of heat energy to the compressible fluid 188, which increases its temperature and pressure.

In section 178B, the displacer 186 displaces the ferrofluid 192A in the hot portion 180B, which in combination with the displacer 186 causes the compressible fluid within the cavity 178B to fill the cold section 182B. The magnetic component 198A stabilizes the ferrofluid 192A within the hot section 180B, to prevent the ferrofluid 194A from escaping to the cold section 182B. Additionally, the magnetic component 198B stabilizes the ferrofluid 194B in the cold section 182B. Thus, the compressible fluid 190 within the cavity 178B is exposed to the cold section 174B of the container 174, resulting in a transfer of heat energy from the compressible fluid 190, which decreases its temperature and pressure.

During the heating of the compressible fluid 188 in the cavity 178A and the cooling of the compressible fluid 190 in the cavity 178B, the piston member 176 is maintained in its position adjacent the cavity 178A, as shown in FIG. 6A. As a result, pressure builds in the cavity 178A due to the heating of the compressible fluid 188, and pressure decreases in the cavity 178B due to the cooling of the compressible fluid 190. As a result, a differential pressure develops across the piston member 176.

The next stage is illustrated in FIG. 6B and is initiated by releasing the piston member 176. The piston member 176 then moves toward the cavity 178B along the axis 175 due to the differential pressure across the piston member 176, as indicated in phantom lines in FIG. 6B. During this movement of the piston member 176B, mechanical, electrical, pneumatic, or hydraulic energy is extracted by means of a suitable connection to the piston member 176. The compressible fluid 188 in the cavity 178A is allowed to expand toward the cold section 182B, and the compressible fluid 190 in the cavity 178B is compressed. The ferrofluid 192B is displaced toward the cavity 178B, and is stabilized within the cold portion 182A by the magnetic component 196B. The ferrofluid 194B is displaced further into the cold portion 182B, and is stabilized within the cold portion 182B by the magnetic component 198B. The magnetic fields generated by the magnetic components 196B and 198B prevent the compressible fluids 188 and 190 in the cavities 178A and 178B from being entrained in the ferrofluid 192B and 194B, respectively.

Figure 6C:
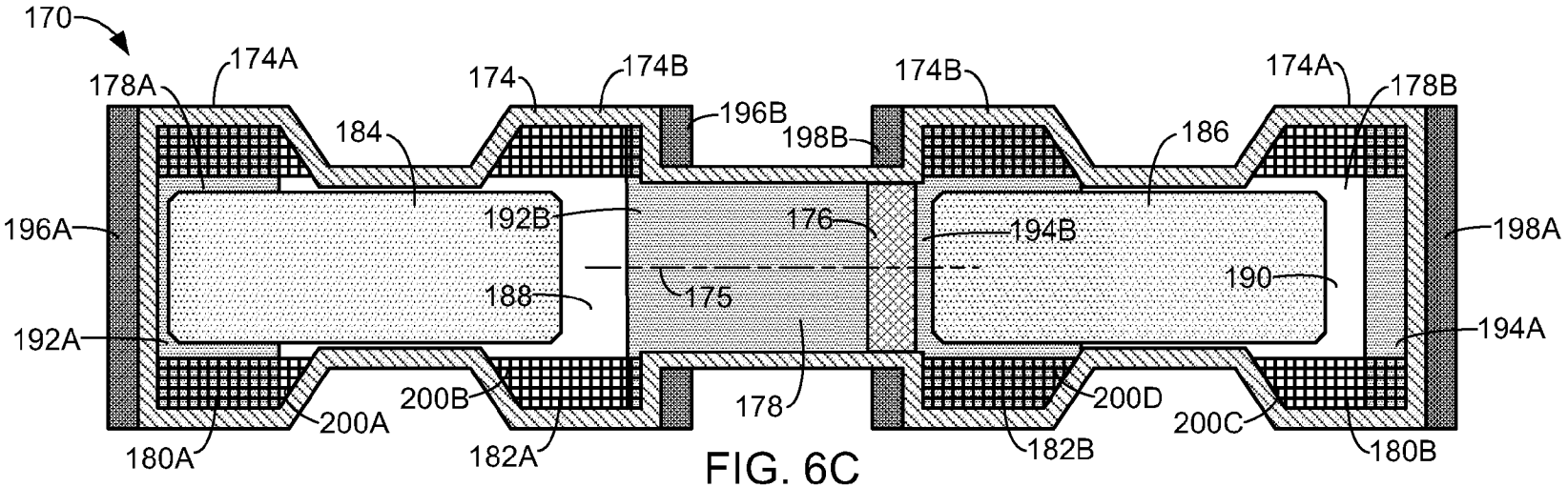

Following the completion of the second stage (FIG. 6B), the piston member 176 is once again arrested adjacent the cavity 178B, as shown in FIG. 6C. The displacers 184 and 186 are respectively shifted toward the hot section 180A of the cavity 178A and the cold section 182B of the cavity 178B, as shown in FIG. 6C. The displacer 184 displaces the ferrofluid 192A within the hot portion 180A, which displaces the compressible fluid 188 in the cavity 178A into the cold section 182B. The displacer 186 displaces the ferrofluid 194A within the cold portion 182B, which displaces the compressible fluid 190 in the cavity 178B into the hot section 180B. The ferrofluid 192A is stabilized or held within the hot portion 180A of the cavity 178A by the magnetic field of the magnetic component 196A, and the ferrofluid 194B is stabilized or held within the cold portion 182B by the magnetic field of the magnetic component 198B. This prevents entrainment of the compressible fluid 188 in the ferrofluid 192A, and entrainment of the compressible fluid 190 in the ferrofluid 194B. The piston member 176 remains in its position adjacent the cavity 178B as the compressible fluid 188 in the cavity 178A is cooled and pressure is reduced in the cavity 178A, and the compressible fluid 190 in the cavity 178B is heated and pressure is increased in the cavity 178B. This creates a differential pressure across the piston member 176.

Figure 6D:
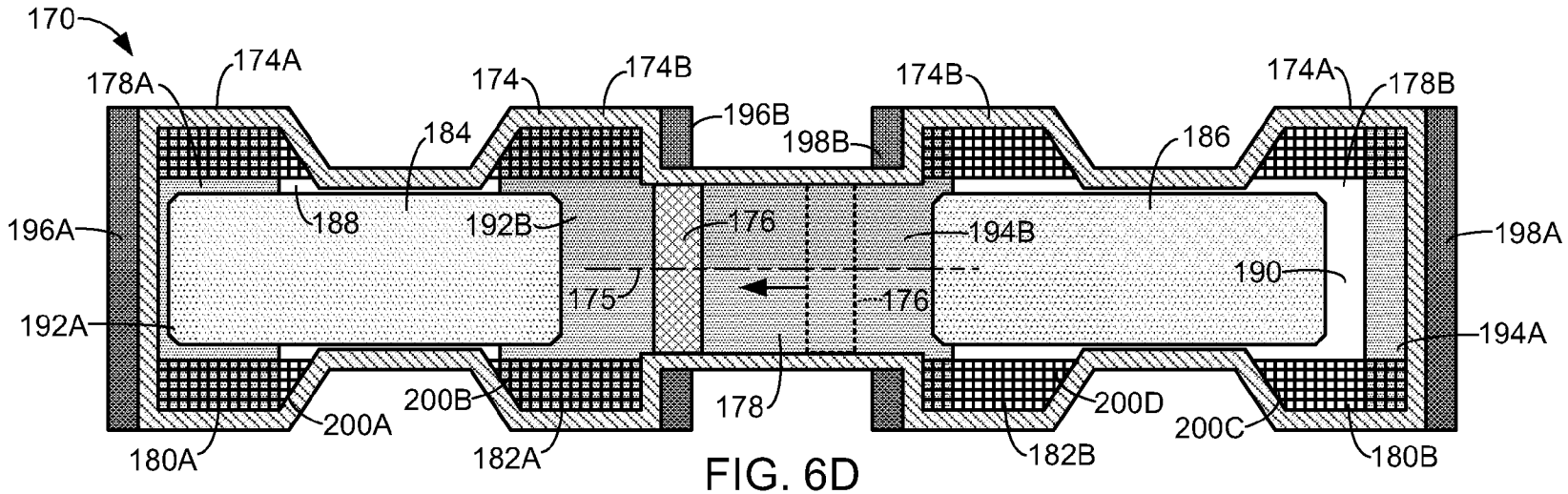

After a sufficient differential pressure is reached across the piston member 176, the piston member 176 is released and the differential pressure drives the piston member 176 along the axis 175 toward the cavity 178A, as indicated in phantom lines in FIG. 6D. Mechanical, electrical, pneumatic, or hydraulic energy is extracted during this movement of the piston member 176. After the piston member returns to the position adjacent the cavity 178A, the displacers 184 and 186 are moved relative to the container 174 back to their positions within the hot portion 180A and the cold portion 182B, as shown in FIG. 6A, and the cycle repeats.

Some embodiments of the device 170 include one or more heat exchange structures, generally referred to as 200, within the interior cavity 178. The one or more heat exchange structures 200 may be formed in accordance with one or more embodiments of the heat exchange structure 162 described above.

In some embodiments, the heat exchange structure 200 includes one or more heat exchange structures within the cavity 178A, such as a heat exchange structure 200A located within the hot portion 180A, and/or a heat exchange structure 200B located in the cold portion 182A, as shown in FIG. 6A. Likewise, in some embodiments, the heat exchange structure 200 includes one or more heat exchange structures within the cavity 178B, such as heat exchange structure 200C located in the hot portion 180B, and/or heat exchange structure 200D located in the cold portion 182B, as shown in FIG. 6A.

In some embodiments, the ferrofluid 192 and 194 within the cavities 178A and 178B engage the heat exchange structures 200 within the cavities 178A and 178B. For example, in some embodiments, the ferrofluid 192A engages heat exchange structure 200A, and/or the ferrofluid 192B engages heat exchange structure 200B that are within the cavity 178A. In some embodiments, the ferrofluid 194A engages the heat exchange structure 200C, and/or the ferrofluid 194B engages the heat exchange structure 200D, that are within the cavity 178B.

The heat exchange structures 200 operate to increase the rate of heat transfer between the compressible fluids 188 and 190 and the corresponding hot sections 174A and the cold sections 174B of the container 174. Additionally, the heat exchange structures 200 operate to increase the rate of heat transfer between the volumes of ferrofluid 192 and 194, and the corresponding hot sections 174A and the cold sections 174B of the container 174. This results in more efficient operation of the device 170.

Although the present invention has been described with reference to preferred embodiments, workers skilled in the art will recognize that changes may be made in form and detail without departing from the spirit and scope of the invention. Embodiments of the invention include the foregoing devices formed in accordance with one or more described embodiments, and methods of operating the devices.

COPYRIGHT NOTICE

A portion of the disclosure of this patent document contains material that is subject to copyright protection. The copyright owner has no objection to the facsimile reproduction by anyone of the patent document or the patent disclose, as it appears in the Patent and Trademark Office patent files or records, but otherwise reserves all copyright rights whatsoever. The following notice applies to the software and data as described below and in the drawings that form a part of this document: Copyright Regents of the University of Minnesota, Minneapolis, Minn.

All Rights Reserved.

What is claimed is:

1. A device for use in compressing and/or expanding a working fluid comprising:

a container;

a piston having a piston face, the piston face and the container defining an interior cavity having a volume that varies in response to movement of the piston relative to the container;

working fluid contained in the interior cavity;

ferrofluid contained in the interior cavity; and at least one magnetic component having a magnetic field that exerts magnetic forces on the ferrofluid that stabilize the ferrofluid in a subset of the interior cavity, wherein the working fluid is displaced within the interior cavity by the ferrofluid.

2. The device according to claim 1, wherein a ferrofluid-gas interface is stabilized by the magnetic field during pressurization and/or depressurization of the working fluid in response to movement of the piston relative to the container.

3. The device according to claim 2, wherein the ferrofluid is stabilized by the magnetic field on the piston face or on an interior surface of the container that opposes the piston face.

4. The device according to claim 3, wherein a surface of the ferrofluid at the ferrofluid-working fluid interface is stabilized by the magnetic field in a substantially planar shape.

5. The device according to claim 3, wherein a surface of the ferrofluid at the ferrofluid-working fluid interface is stabilized by the magnetic field in a substantially non-planar shape.

6. The device according to claim 5, wherein the surface of the ferrofluid at the ferrofluid-working fluid interface is stabilized by the magnetic field in a convex or concave shape.

7. The device according to claim 3, wherein the magnetic component is external to the interior cavity, within a wall of the container, attached to a wall of the container, within the piston, or attached to the piston.

8. The device according to claim 7, wherein the magnetic component is selected from the group consisting of a permanent magnet and an electromagnet.

9. The device according to claim 3, wherein the interior cavity includes an expanded state, in which the piston face is displaced a first distance from the interior surface of the container, and a contracted state, in which the piston face is displaced a second distance, which is less than the first distance, from the interior surface of the container.

10. The device according to claim 9, further comprising a heat transfer structure within the cavity configured to transfer heat with the working fluid and the ferrofluid.

11. The device according to claim 10, wherein the heat transfer structure is within the ferrofluid when the interior cavity is in the contracted state.

12. The device according to claim 11, wherein the ferrofluid is displaced from heat transfer structure when the interior cavity is in the expanded state.

13. The device according to claim 9, further comprising:

a high pressure reservoir containing a volume of the working fluid under high pressure;

a low pressure reservoir containing a volume of the working fluid under low pressure; and valving selectively fluidically coupling the working fluid in the high and low pressure reservoirs to the interior cavity.

14. The device according to claim 13, wherein:

the valving fluidically couples the high pressure reservoir to the interior cavity during or following the interior cavity transitioning from the expanded state to the contracted state; and the valving fluidically couples the low pressure reservoir to the interior cavity during or following the interior cavity transitioning from the contracted state to the expanded state.

15. The device according to claim 14, further comprising an actuator configured to drive relative movement between the container and the piston.

16. The device according to claim 13, wherein:

the valving fluidically couples the high pressure reservoir to the interior cavity during or following the interior cavity transitioning from the contracted state to the expanded state; and the valving fluidically couples the low pressure reservoir to the interior cavity during or following the interior cavity transitioning from the expanded state to the contracted state.

17. A device comprising:

a container defining an interior cavity, the container having hot and cold sections;

a piston member divides the interior cavity into first and second cavities, and is configured to move between a first position, in which the piston member is near the first cavity and displaced from the second cavity, and a second position, in which the piston member is near the second cavity and displaced from the first cavity, each of the first and second cavities includes a hot portion and a cold portion corresponding to the hot and cold sections of the container;

a first displacer in the first cavity configured to move relative to the container;

a second displacer in the second cavity configured to move relative to the container;

a working fluid in the first and second cavities;

ferrofluid in the first and second cavities; and a first magnetic component positioned adjacent the first cavity and a second magnetic component positioned adjacent the second cavity, the first and second magnetic components each having a magnetic field that exerts magnetic forces that stabilize the corresponding ferrofluid in a subset of the corresponding first and second cavities.

18. The device according to claim 17, wherein:

the first magnetic component is positioned adjacent the hot portion of the first cavity, and the magnetic field of the first magnetic component stabilizes a volume of the ferrofluid within the hot portion of the first cavity;

the second magnetic component is positioned adjacent the hot portion of the second cavity, and the magnetic field of the second magnetic component stabilizes a volume of the ferrofluid within the hot portion of the second cavity; and the device further comprises:

a third magnetic component positioned adjacent the cold portion of the first cavity, and the magnetic field of the third magnetic component stabilizes a volume of the ferrofluid within the cold portion of the first cavity; and a fourth magnetic component positioned adjacent the cold portion of the second cavity, and the magnetic field of the fourth magnetic component stabilizes a volume of the ferrofluid within the cold portion of the second cavity.

19. The device according to claim 17, further comprising a heat transfer structure within each of the first and second cavities.

20. The device according to claim 19, wherein the ferrofluid in the first cavity engages the heat exchange structure within the first cavity, and the ferrofluid in the second cavity engages the heat exchange structure within the second cavity.

* * * * *